United States Patent [19]

Hong

[11] Patent Number: 4,907,430

[45] Date of Patent: Mar. 13, 1990

[54] CENTRAL CONTROL CASE LOCK

[75] Inventor: Yan C. Hong, Chang Hua, Taiwan

[73] Assignee: Pao Tao Lock Ltd., Chan Hua, Taiwan

[21] Appl. No.: 232,215

[22] Filed: Aug. 15, 1988

[51] Int. Cl.[4] ..... E05B 37/02

[52] U.S. Cl. ..... 70/312; 70/71

[58] Field of Search ..... 70/312, 67, 68, 69, 70/70, 71, 72, 73, 74, 75, 76

[56] References Cited

U.S. PATENT DOCUMENTS

| | | | |
|---|---|---|---|
| 3,555,860 | 1/1971 | Atkinson | 70/312 |
| 4,281,525 | 8/1981 | Bako | 70/71 |
| 4,366,685 | 1/1983 | Remington | 70/70 |
| 4,395,892 | 8/1983 | Remington | 70/312 |
| 4,416,126 | 11/1983 | Remington | 70/71 |
| 4,671,088 | 6/1987 | Jeang | 70/312 |
| 4,677,832 | 7/1987 | Remington | 70/67 |

*Primary Examiner*—Robert L. Wolfe

*Attorney, Agent, or Firm*—Cushman, Darby & Cushman

[57] ABSTRACT

The present central control case lock includes a housing, a base plate, an actuating plate pivoted on the base plate, intermediate sleeve pieces rotatably mounted on the base plate and capable of pivoting the actuating plate, numbered wheels respectively attached on the sleeve pieces, and two locking mechanisms slidably mounted on two sides of the housing and capable of being secured to the actuating plate when it is pivoted by the sleeve pieces.

1 Claim, 4 Drawing Sheets

CENTRAL CONTROL CASE LOCK

BACKGROUND OF THE INVENTION

The present invention relates to a case lock, and more particularly to a central control case lock.

There are numerous kinds of locks for suitcases, baggage cases or cosmetic cases with substantially the same working principle. But they are differently constructed to meet with various needs. A central control case lock is referred to a lock which is incorporated with a side frame of a case and has a central numerical lock controlling two side locking mechanisms. Conventionally, the central control case lock has the central numerical lock and the side locking mechanisms interconnected through complicated transmitting and linking mechanisms and is composed of numerous complicated parts which are assembled together by screws or rivets which results in a tedious and time-consuming assembling procedure. It is therefore tried by the Applicant to deal with the above situation.

SUMMARY OF THE INVENTION

It is therefore an object of the present invention to provide a central control case lock having a reduced cost.

It is further an object of the present invention to provide a central control case lock with parts thereof having a cooperating relationship thereamong capable of being precisely controlled.

It is yet an object of the present invention to provide a central control case lock with parts thereof being secured together without or with the lease screws or rivets.

The present invention is based on the recognition that the central numerical lock can be designed to directly control the reciprocating movement of the side locking mechanisms.

According to the present invention, a central control case lock includes a housing having a central portion and two side portions, a numerical lock set mounted at the central portion and having a pivotable actuating plate having engaging ends, and two locking mechanisms respectively slidably mounted on the two side portions and each of which includes a first engaging piece capable of being secured to one of the engaging ends when the numerical lock has wrong numbers on the numerical wheels and a second engaging piece capable of securing thereto an engaging medium of the case to be locked by the case lock.

The present invention may best be understood through the following description with reference to the accompanying drawings, in which:

DETAILED DESCRIPTION OF THE PREFERRED EMBODIMENT

Figure 1:
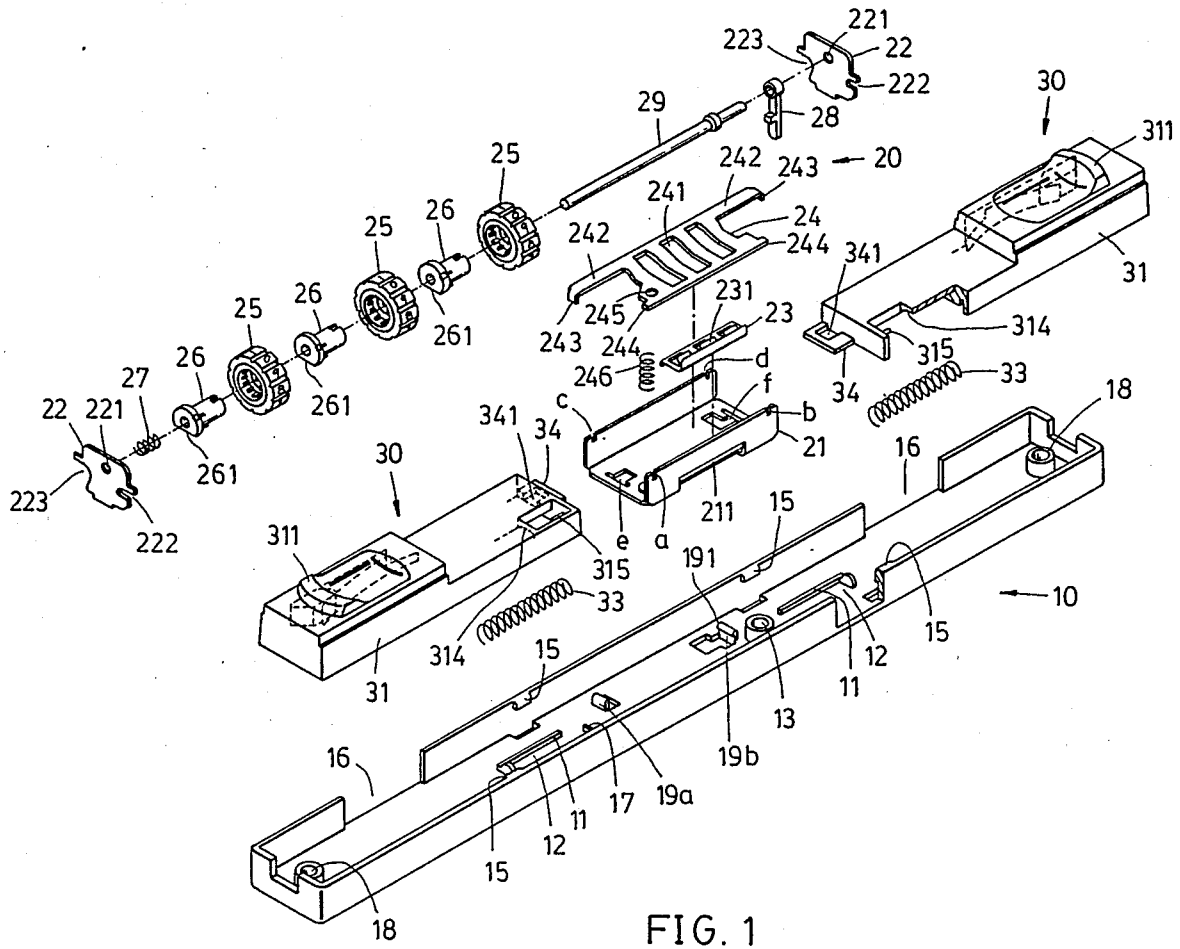
FIG. 1 is an exploded view of a preferred embodiment of a central control case lock according to the present invention.
Figure 2:
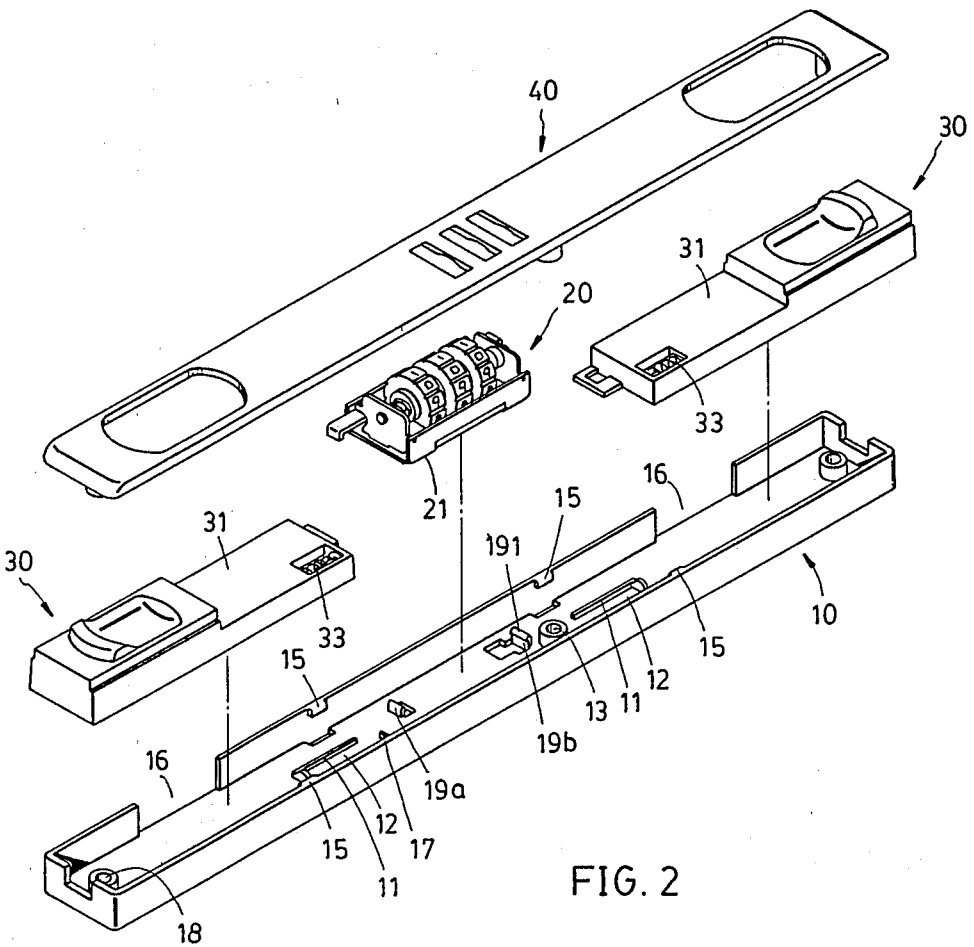
FIG. 2 is a partly assembled view of a case lock in FIG. 1.
Figure 3:
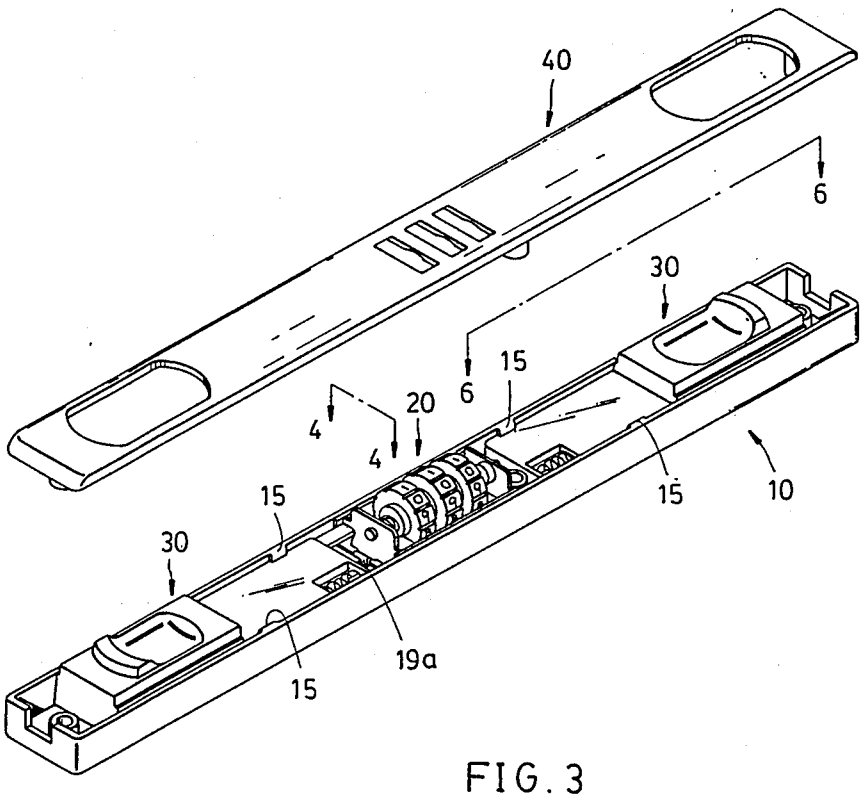
FIG. 3 is a fully assembled view of a case lock in FIG. 1.

Referring now to FIGS. 1–3 and 8, the present central control case lock includes a generally un-topped parallelepipedal housing 10 having a central portion mounting thereon a numerical lock 20 and two side portions respectively slidably mounting thereon two locking mechanisms 30, and being covered by a cover plate 40. Housing 10 can be made of plastics by injection molding and includes two L-shaped pieces 11 defining two symmetrical positioning space 12, a first positioning post 13, four top projections 15 for confining and sliding locking mechanisms 30 in the housing side portions, side openings 16 for passing therethrough engaging medium 50 of a case to be locked by the present lock, a second positioning piece 17, two end bolt holes 18 for bolting thereto cover 40, and two bottom upward protuberances **19*a*, 19*b* with protuberance 19*b* having a hooking tip 191**.

Numerical lock 20 includes a base plate 21 snap-fitted between protuberances **19*a*, 19*b* and having grooves a, b, c, d, e, and f, two side plates 22 positioned by grooves a–f and having holes 221 and grooves 222 and 223, an elastic thin plate 23 having three projections 231 and retained to an indentation 211 of base plate 21, an actuating plate 24 having three wheel holes 241, a first longitudinal side 244 pivotally mounted in grooves 222, a second longitudinal side 242 having two engaging ends 243 respectively protruding beyond grooves 223, and a bottom projection 245 retaining thereon one end of a spring 246 always biassing upwards second longitudinal side 242, a shaft 29 mounted on holes 221, a number-changing piece 28 together with a spring 27 and 3 intermediate sleeve pieces 26 being sleeved on shaft 29, and 3 numbered wheels 25 respectively attached on sleeve pieces 26 and pressed against projections 231. Since the working principle of such numerical lock 20** is notoriously known in the art, e.g. U.S. Pat. No. 4,671,088, further details will not be given here.

Locking mechanism 30 is a slide member 31 having a thumbing portion 311, a receiving room 312 receiving therein an engaging piece 313 capable of being hooked by engaging medium 50 and an elastic member 32 for urging engaging medium 50 out of receiving room 312, a spring 33 received in positioning space 12 for providing a restoring force, a positioning surface 314 helping positioning space 12 position therein spring 33, a retaining pin 315 retaining thereon one end of spring 33, and an integrally formed engaging piece 34 having a hole 341 in which engaging end 243 having been tip-hooked can engage to fix thereto engaging piece 34.

Cover 40 can be made of plastics by injection molding and hides numerical lock 20 and locking mechanisms 30 in housing 10.

Upon assembling, numerical lock 20 and locking mechanisms 30 are first assembled and then through the elasticity of housing 10, locking mechanisms 30 are fitted in two side portions of housing 10 to be slidable therein. Then, numerical lock 20 is snap-fit in the central portion of housing 10 between protuberances 19*a*, 19*b* with hooking tip 191 hooking on base plate 21.

Figure 4:
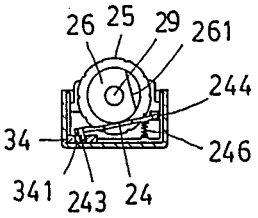
FIG. 4 is a sectional view taken along line 4—4 in FIG. 3.
Figure 6:
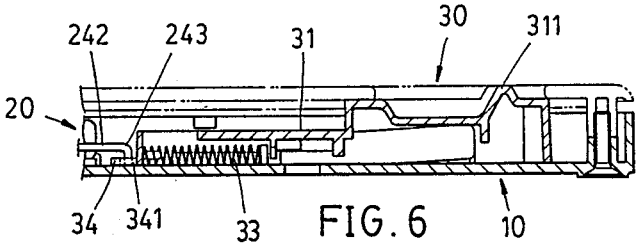
FIG. 6 is a sectional view taken along line 6—6 in FIG. 3.

As shown in FIGS. 4 and 6, if numerical wheels 25 have wrongly presented numbers, circular surfaces of sleeve pieces 26 will pivot second longitudinal side 242 downwardly about first longitudinal side 244 so that hooking tips 243 will engage in holes 341 of engaging pieces 34 being thus non-slidable in the housing side portions which retains engaging media 50 in side openings 16 and hooking on engaging pieces 313 of locking mechanisms 30 so that the case provided with the present case lock is in a locked state.

Figure 5:
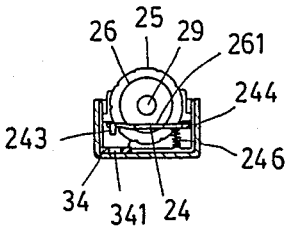
FIG. 5 is a sectional view similar to FIG. 4 but showing a different state of the central numerical lock.
Figure 7:
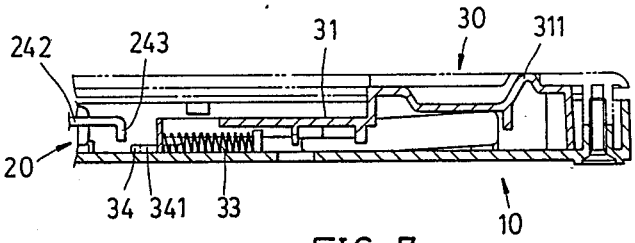
FIG. 7 is a sectional view similar to FIG. 6 but showing a different state of the locking mechanism.
Figure 8:
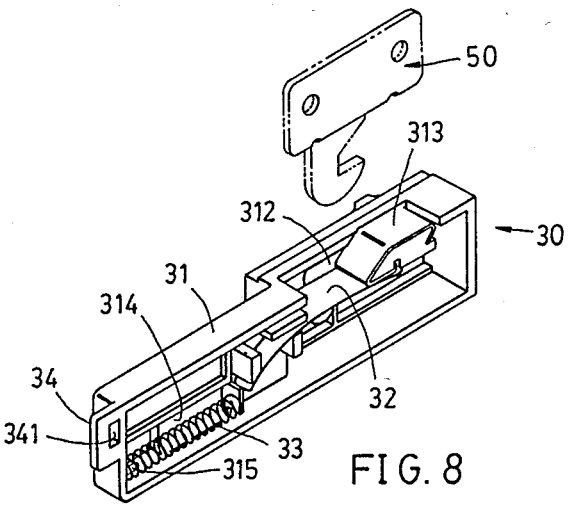
FIG. 8 is a perspective view showing a locking mechanism of a case lock in FIG. 1 and an engaging medium of a case to be locked by the present case lock.

As shown in FIGS. 5 and 7, if numerical wheels 25 get correct numbers, flat surfaces 261 of sleeve pieces 26 will allow spring 246 to pivot upwardly second longitudinal side 242 to release hooking tips 243 from holes 341 so that one can outwardly thumb thumbing portions 311 to disengage engaging media 50 from engaging pieces 313 to let elastic members 32 spring upwards engaging media 50.

It can be noticed that assembling numerical lock 20 and locking mechanisms 30 needs no screw or rivet and can be easily and quickly done. The relative position among housing 10, numerical lock 20 and locking mechanisms 30 can also be precisely controlled.

Through the above description, it should become readily apparent now how and why the present invention can achieve its objects.

What I claim is:

1. A central control case lock comprising:

a parallelepiped housing having an open top, a bottom hole and a longitudinal side wall having two ends thereof respectively provided with two locking hook holes for respectively passing therethrough two locking hooks provided on a case cover of a case;

two locking mechanisms symmetrically received in two opposite ends of said housing, each locking mechanism including a sliding member having a retaining opening corresponding to one of said locking hook holes for retaining therein a corresponding locking hook, and an elastic element mounted on said sliding member for enabling said member to be slidable in said housing within a predetermined length; and a numerical lock received in a central portion of said housing, including a base plate having two side plates respectively provided on two sides of said base plate, a pivoting shaft positioned between said side plates, a plurality of numbered wheels, a plurality of number changing cams each capable of being synchronously rotated with said wheels, a number-changing stem having a first end connected to said shaft and a second end passing through said bottom hole, and an actuating plate mounted beneath said wheels and having a free side edge capable of being set in a limited vertically pivoting movement with respect to a longitudinal axis thereof when actuated by said cams, wherein:

said sliding member integrally includes an engaging piece having a hole;

said free side edge has two engaging ends which extend therefrom, each having a tongue downwardly extending therefrom and an engaging portion engageable in said hole in order to lock in position said respective lock mechanism;

two longitudinal side walls of said housing respectively have top inner edges thereof provided with a plurality of engaging lugs for respectively engaging with top surfaces of two said sliding members; and said housing further including two spaced bottom engaging lugs one of which forms at a top end thereof a hooking portion for engaging said numerical lock in position.

* * * * *